United States Patent [19]

Patriarca et al.

[11] 4,340,006

[45] Jul. 20, 1982

[54] SEMI-AUTOMATIC BAILER PLUG

[76] Inventors: William C. Patriarca, 10232 Prince Pl., T-2; Leonard J. McGraw, 10247 Prince Pl., T-3, both of Largo, Md.

[21] Appl. No.: 120,845

[22] Filed: Feb. 12, 1980

Related U.S. Application Data

[63] Continuation-in-part of Ser. No. 8,576, Feb. 1, 1979, Pat. No. 4,198,918.

[51] Int. Cl.[3] ..... B63B 13/00

[52] U.S. Cl. ..... 114/197; 114/183 R; 114/183 A; 137/410; 251/251

[58] Field of Search ..... 251/251, 253, 254; 137/410, 421; 114/183 R, 183 A, 184, 185, 197, 198, 212, 182

[56] References Cited

U.S. PATENT DOCUMENTS

| | | | |
|---|---|---|---|
| 2,909,144 | 10/1959 | Baldwin | 114/185 |
| 2,965,126 | 12/1960 | Hallinan | 137/410 |
| 3,188,994 | 6/1965 | Dawson | 114/197 |
| 3,550,548 | 12/1970 | De Persia | 114/183 R |
| 4,198,918 | 4/1980 | Patriarca | 114/197 |

*Primary Examiner*—Trygve M. Blix
*Assistant Examiner*—D. W. Keen
*Attorney, Agent, or Firm*—Birch, Stewart, Kolasch & Birch

[57] ABSTRACT

A semi-automatic boiler plug assembly having a mounting plate with a central hole aligned with a bailer hole on a boat transom is described. Attached to the mounting plate is a cylinder and piston therein made of a resilient material which seats in the central hole of the mounting plate in a closed position. Two arms extending to either side of the piston, and through slots on opposite sides of the cylinder, guide the piston in its travel back and forward in the cylinder. Immediately behind the piston is a spring to bias the piston forward in the cylinder toward the closed position. On the outside of the cylinder are two hinge plates attached to the piston by guide arms and by hinge pins that pass through a hole in the hinge plates and into the piston guide arms. Formed onto the outboard side of the hinge plates are hollow chambers which form floats. Across the rear edge and placed perpendicular to the hinge plates, and extending beyond the two hinge plates to the outermost face of each float is a coupling plate. The coupling plate joins together both hinge plates and floats to comprise a hinged float assembly which pivots in unison to open or close the bailer hole. The outer face of the coupling plate is fluted, serrated or otherwise deformed to create a rough surface to assist the automatic triggering of the spring-biased bail plug when the boat transom is placed in the water.

5 Claims, 6 Drawing Figures

SEMI-AUTOMATIC BAILER PLUG

BACKGROUND OF THE INVENTION

This is a continuation-in-part of prior pending application Ser. No. 008,576 filed Feb. 1, 1979, entitled SEMI-AUTOMATIC BAILER PLUG, now U.S. Pat. No. 4,198,918.

FIELD OF THE INVENTION

The present invention relates to a device for use with boats of various sizes, such as may be launched and raised to and from the water surfaces periodically for various reasons. During each launching and raising period bailing out of bilge water collected in the boat by some suitable means is necessary. The bilge water is discharged from a bail hole usually in the boat transom, said hole being required to be closed with a proper size bail plug when launched into the water. The novel bail plug of this invention is automatically projected into the boat transom bail hole upon release of a compressed spring in response to buoyant and frictional forces on float members, and is opened in response to manual manipulation of the floats which recompress the spring accompanying a raising period of the boat from the water.

DESCRIPTION OF THE PRIOR ART

Heretofore, there have been various arrangements of bailer plugs used to plug the transom bail hole, such as rubber stoppers, screws plugs or the like. Usually such plugs are not attached to the boat in any way. As a result, in many instances the plugs are lost or misplaced unless they are attached to the boat in some manner. Accordingly, when the boater goes to launch his craft, he must locate a bail plug to manually seal the bail hole before he can launch the same into the water.

Typical of some other prior art boat bailer plugs, which are attached to the hull of a boat, are U.S. Pat. Nos. 2,730,062 to Mitchell and 3,004,511 to Moeller, which show manually opened bail plugs and spring-biased plugs to close the bail holes upon manual release.

Examples of other prior art bailer plugs are illustrated in U.S. Pat. No. 3,394,671 to Mayer which discloses an automatic bailer plug including a ball float member 71 mounted in a shroud 69 adjacent the bail hole. The ball 71 in the Mayer device is water actuated under some conditions to close the bail hole.

Other U.S. Pat. Nos. which show the general state of the art of bailer plugs mounted in boats are as follows:

U.S. Pat. No. 3,400,683—De Forest—Sept. 10, 1968;

U.S. Pat. No. 3,757,726—Moeller—Sept. 11, 1973;

U.S. Pat. No. 4,075,965—Lasch—Feb. 28, 1978.

None of the aforementioned prior art bailer plug arrangements disclose an assembly which is automatically actuated to close a bail hole in a boat transom accompanying the launching of the boat into the water. Accordingly, in the prior art devices there is a danger that the boats associated with those devices will take on water as launching into the water occurs.

OBJECTS OF THE INVENTION

Accordingly, an object of this invention is to provide a semi-automatic bail plug in combination with float control means to trigger and project said plug to a closed position in a bail hole of a boat transom when the boat is launched to a water surface.

Another object of the present invention is to provide a security release means for a spring-loaded bail plug whereby release of the bail plug from the bail hole is only effected by manual activation of the bail plug spring.

Briefly, the useful novel aspects of this invention reside in the provision of a novel semi-automatic bailer plug assembly wherein the bailer plug is manually cocked in an armed spring-biased open position and is triggered by buoyant and frictional forces to automatically close the bail hole when the boat with the assembly attached is launched.

BRIEF DESCRIPTION OF THE DRAWINGS

With the foregoing objects and advantages and other novel features which will become apparent as the invention is fully understood, the same resides in the novelty of construction, combination and arrangement of parts hereinafter described in detail and distinctly claimed in conjunction with the accompanying drawings, wherein:

SUMMARY

Figure 1:
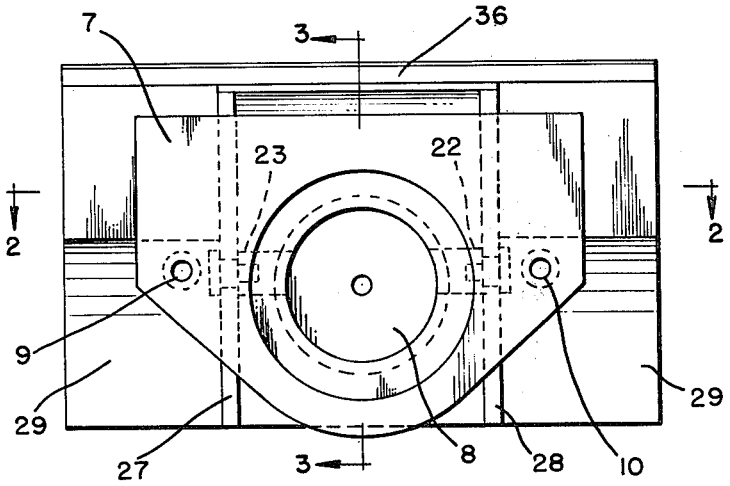
FIG. 1 is a front elevation view of the present invention assembled as a unitary structure for mounting with the bail hole of the mounting plate in position to be secured in axially aligned registry with the bail hole in bail hole closing position of any suitable boat transom.

The device of the present invention consists of a mounting plate with two holes to facilitate attachment to the outboard side of a suitable boat transom with screws, bolts, or any other fastening device, suitable for such purpose. A larger hole is placed at the approximate center of the mounting plate. This hole will be aligned with the bailer hole on the boat transom at the time the mounting plate is attached to the boat transom.

Attached to the mounting plate is a cylinder and piston in the cylinder which extends rearward away from the mounting plate. Within the cylinder is the forward end of the cylinder is the bailer plug made of a resilient material which seats against the mounting plate when the plug is in a closed position. Immediately behind the bailer plug in the cylinder and attached to the bailer plug is a piston which directs the bailer plug toward and away from the bailer hole in the mounting plate at the base of the cylinder. Two arms extending to either side of the piston, and through slots on opposite sides of the cylinder, guide the piston in its travel back and forward in the cylinder. Immediately behind the piston is a spring which is compressed between the piston and the interior top of the cylinder. This spring provides the work to move the piston forward in the cylinder. On the outside of the cylinder are two hinge plates attached to the piston by guide arms and by hinge pins that pass through a hole in the hinge plates and into the piston guide arms. These hinge plates, when attached are in a vertical plane from the mounting plate. Formed onto the outboard side of the hinge plates are hollow chambers which form floats. Across the rear edge and placed perpendicular to the hinge plates, and extending beyond the two hinge plates to the outermost face of each float is a coupling plate. The coupling plate joins together both hinge plates and floats to comprise a hinge float assembly which moves in unison. The outer face of the coupling plate is fluted, serrated or otherwise deformed to create an other than smooth surface to facilitate automatic triggering of the spring-biased bail plug to seal closed the bail hole by projection of the bail plug into the bail hole.

DETAILED DESCRIPTION OF THE INVENTION

Referring in detail to the several assembled parts by numerals applied to the Figures of the drawings and first with reference to FIGS. 1, 2, 3 and 4, there is shown a mounting plate 7 formed with a bailer hole 8 and a pair of spaced holes 9 and 10 for suitable fasteners, such as screws, bolts or the like to secure the same to a boat transom, not shown, with a registering bailer hole of complementary size to the bailer hole of the mounting plate.

A bell-shaped cylinder 12 formed with or suitably attached to the mounting plate 7, extends rearwardly from the outboard side of the mounting plate. This cylinder is a closed dome 11 at the tip and opens at the bottom to provide the bailer hole 8 in plate 7. At the periphery of the bottom of the cylinder is provided a drain slot 14. Also, the cylinder is formed with two guide slots 16 and 17 centrally located on diametrically opposite sides of the cylinder and extending longitudinally in parallel to the central axis of the cylinder.

Mounted in the cylinder is a spring 18, a piston 19 and a bailer plug 20. The piston is formed with guide arms 22 and 23 which project outwardly diametrically from the periphery of the piston 19 along a horizontal axis of the piston into guide slots 16, 17. Preferably said arms are rectangular in cross section and each arm contains a central hole with a bore to receive the end of a hinge pin 25 or 26 in a friction-fit manner, each of which connects with one of a pair of spaced hinge plates 27 and 28. See FIG. 2. The plates are each respectively carried by spaced floats 29—29. See FIGS. 1 and 2.

The spring 18 is mounted under compression between the recessed top interior closed, or bell, end 11 of the cylinder 12 and outboard face of the piston 19. The bailer plug 20 is seated against the inboard surface of the piston. The spring 18 and piston 19 when released, direct the plug to the bailer hole 8 in the mounting plate 7 and to seal an adjacent bail hole in a suitable boat transom, not shown.

The cylinder 12 is provided with an annular recess inboard of the bell or closed end to receive an end coil of the spring 18 and the opposite end coil of the spring seats in a cup-like recess formed in the piston 19, which piston on the opposite side is attached to the bailer plug 20 by a small screw or the like.

Each hinge pin 25 and 26 are similar, and are cylindrically shaped devices with a head 30 and shoulder 31 to serve as a means of connecting the respective hinge plates 27 and 28 to their respective adjacent piston guide arms 22 and 23 projecting thru the cylinder slots 16 and 17. Piston guide arms 22, 23 are slidably mounted in guide slots 16, 17.

Each shoulder 31 serves as a bearing and spacer to provide a pivot for the respective hinge plates 27 and 28 and to inhibit binding of the hinge plates against the piston guide arms 22 and 23 carried by the piston 19.

Figure 2:
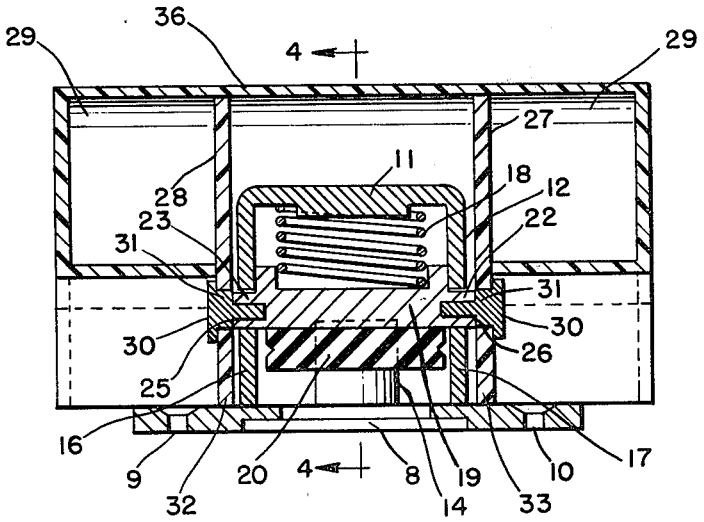
FIG. 2 is a sectional view taken on line 2—2 of FIG. 1 with the bail plug of the float assembly with the bail plug cocked open with respect to the bail hole of the transom mounting plate.
Figure 3:
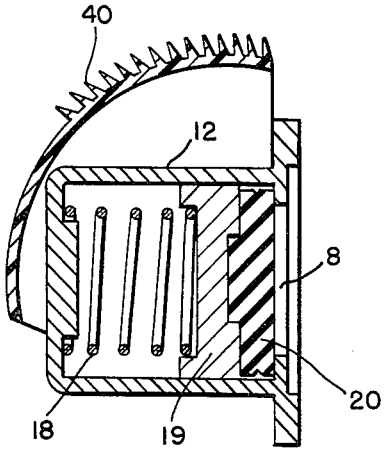
FIG. 3 is a side view in cross section along line 3—3 of FIG. 1 showing the bail plug in closed position.
Figure 4:
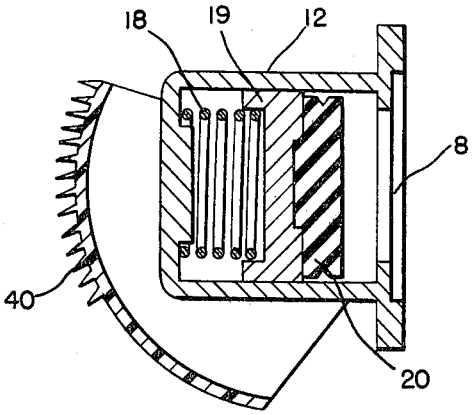
FIG. 4 is a side view in cross section taken along line 4—4 of FIG. 2 showing the bail plug in an open position.

Each hinge plate is formed with inboard edges to provide stops 32 and 33 arranged to swing into the same plane as the bailer plug mounting plate 7 when the bailer plug 20 is in open position, see FIGS. 2 and 5, and thus coact with the plane surface of the mounting plate. Such outboard edges of the hinge plates are of circular configuration to define the shape of the floats 29. A coupling plate 36 spans the outermost distance of the two spaced floats 29 and is curved to conform to the circular configuration of the hinge plates 27, 28. The outer surface of the said coupling plate 36 may have flutes or serrations 40. Plate 36 is attached to the respectively adjacent hinge plates 27 and 28 and floats 29 to provide a float assembly.

The piston guide slots 16 and 17 on opposite sides of the cylinder 12 are formed with longitudinal center lines parallel to the longitudinal center axis of the cylinder with the vertical dimension of the slots slightly greater than the vertical dimension of the piston guide arms 22 and 23 and terminate some distance from the top or dome 11 of the cylinder 12.

Thus, when the piston 19 is imparted movement by spring 18 within the cylinder 12, it directs the bailer plug 20 to the bailer hole 8 in plate 7. See FIG. 3. This will now be summarized in the following description of operation.

DESCRIPTION OF OPERATION

The semi-automatic bailer plug is fastened to the outboard side of a boat transom. The mounting plate 7 is centered over the bail hole in the boat transom by aligning said hole with the bailer hole 8 in the mounting plate. The mounting plate 7 is attached to the boat transom by means of screws, bolts or other suitable devices used for this purpose. Holes 9 and 10 are provided in the mounting plate for this purpose.

Figure 5A:
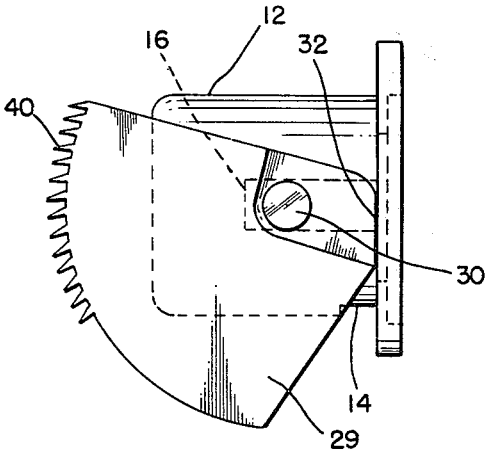
FIGS. 5A and 5B are views in side elevation showing the hinge plate and float on one side of the assembly in a cocked-open position and closed position, respectively.
Figure 5B:
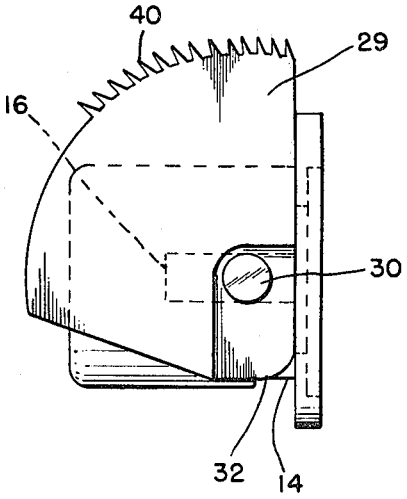

When the plug 20 is in an open position (FIG. 5A) and the boat is launched into the water, a buoyant force acting on the floats 29 and the friction created by the water against the deformed surface 40 of the coupling plate 36 cause the float assembly to rotate about the hinge pins in an upward direction causing stop edges 32,33 of the hinge plates 27, 28 to rotate away from the mounting plate toward the position of FIG. 5B. Then, because of the eccentricity of the hinge plate stop edges 32, 33 relative to the hinge pins 25, 26, a cam-like or overcenter snap-action is created and the restraint on the spring 18 is released forcing the piston 19 forward in the cylinder thereby guiding the bailer plug 20 over the bailer hole 8, thus sealing the bailer hole. The spring being still somewhat compressed in this extended position maintains the plug 20 against the bailer hole 8.

When the boat is out of the water the semi-automatic bailer plug is opened by manually pushing downward against the float assembly until the hinge plate stop edges 32, 33 rest against the mounting plate, as in FIG. 5A. The bailer plug 20 will now remain in an open position allowing accumulated water in the boat to drain out of the boat through the bail hole into the cylinder and out of the cylinder through the drain slot 14 in the bottom of the cylinder and the piston guide slots 16, 17 in the sides of the cylinder.

It is believed that the illustrations of FIGS. 5A and 5B make the overcenter snap-action operation of the device of the present invention quite clear. It should be noted this overcenter snap-action is created by the eccentricity of the hinge plate stop edges 32, 33 to the hinge pins 25, 26, as described above, and further due to the sliding pivot points at 25, 26. That is, pins 25, 26 are mounted in guide arms 22, 23 which slide in guide slots 16, 17. Thus, the hinge pins 25, 26 are in different respective positions in slots 16, 17 in the two operative positions of FIGS. 5A and 5B.

It is to be expressly understood that the invention is not intended to be limited solely as illustrated in the drawings and various changes may be made in the combination and arrangement of the parts illustrated, as will now likely appear to others and those skilled in the art.

We claim:

1. A bailer plug control assembly for boat transoms having a bail hole for discharging bilge water from a boat comprising:

support means for mounting said bailer plug assembly in alignment with a boat transom bail hole;

a bail plug guide means connected to said support means;

a bail plug mounted in said bail plug guide means for movement between a closed position in which said bail plug seals said bail hole and an open position in which said bail plug permits the discharge of bilge water through said bail hole;

spring means coupled to said bail plug for driving said bail plug along said guide means toward said closed position to seal said bail hole;

locking means for holding said bail plug in said open position against the driving action of said spring means when said boat transom is out of the water; and float means responsive to water contact accompanying the launching of the boat transom for releasing said locking means to permit said spring means to drive said bail plug into said closed position to seal said bail hole, said float means being pivotally mounted with respect to said support means and pivotable in response to said water contact to release said locking means.

2. A bailer plug control assembly for boat transoms having a bail hole for discharging bilge water from a boat comprising:

support means for mounting said bailer plug assembly in alignment with a boat transom bail hole;

a bail plug guide means connected to said support means;

a bail plug mounted in said bail plug guide means for movement between a closed position in which said bail plug seals said bail hole and an open position in which said bail plug permits the discharge of bilge water through said bail hole;

spring means coupled to said bail plug for driving said bail plug along said guide means toward said closed position to seal said bail hole;

guide arm means operatively connected to said bail plug, said guide arm means being slidable in said bail plug guide means;

float means pivotally mounted about a pivot axis in said guide arm means for movement between a first position and a second position, said float means being in said first position when said bail plug is in said open position and being in said second position when said bail plug is in said closed position, said, float means being manually movable to said first position and movable to said second position in response to water contact accompanying the launching of said boat transom, said float means including latch means for normally maintaining said float means in said first position until a sufficient buoyant force is generated by said water contact to pivot said float means to said second position.

3. The bailer plug control assembly of claim 2 wherein said latch means comprises a cam surface on said float means for latching engagement with a surface on said support means when said float means is in said first position, said cam surface being eccentrically disposed with respect to said float means pivot axis to provide an overcenter, snap-acting movement of said float means from said first position to said second position in response to said sufficient buoyant force.

4. The bailer plug control assembly of claims 2 or 3 wherein surfaces of said float means which contact said water have flutes extending substantially parallel to said float means pivot axis.

5. The bailer plug control assembly of claim 2 wherein said bail plug guide means comprises a tubular housing for containing said bail plug and said spring means, said housing having guide slots therein for slidably supporting said guide arm means therein.

* * * * *